US005551286A

United States Patent [19]

Booer

[11] Patent Number: 5,551,286

[45] Date of Patent: Sep. 3, 1996

[54] DETERMINATION OF DRILL BIT RATE OF PENETRATION FROM SURFACE MEASUREMENTS

[75] Inventor: Anthony K. Booer, Ridgefield, Conn.

[73] Assignee: Schlumberger Technology Corporation, Sugar Land, Tex.

[21] Appl. No.: 290,940

[22] PCT Filed: Feb. 22, 1993

[86] PCT No.: PCT/GB93/00368

§ 371 Date: Nov. 21, 1994

§ 102(e) Date: Nov. 21, 1994

[87] PCT Pub. No.: WO93/17219

PCT Pub. Date: Sep. 2, 1993

[30] Foreign Application Priority Data

Feb. 22, 1992 [GB] United Kingdom ..... 9203844

[51] Int. Cl.[6] ..... G01B 5/18; G06F 17/15; E21B 45/00

[52] U.S. Cl. ..... 73/152.45; 73/151.5

[58] Field of Search ..... 73/152, 151.50, 73/151

[56] References Cited

U.S. PATENT DOCUMENTS

| | | | |
|---|---|---|---|
| 2,688,871 | 9/1954 | Lubinski | 73/151.5 |
| 3,777,560 | 12/1973 | Guignard | 73/151.5 |
| 4,843,875 | 7/1989 | Kerbart | 73/151.5 |
| 4,928,521 | 5/1990 | Jardine | 73/151 |
| 5,398,546 | 3/1995 | Jeffryes | 73/151.5 |

*Primary Examiner*—Hezron E. Williams

*Assistant Examiner*—J. David Wiggins

*Attorney, Agent, or Firm*—Peter Y. Lee; Wayne I. Kanak

[57] ABSTRACT

A method of determining the rate of penetration Δd of a drill bit at the end of a drill string while drilling a well, comprising:

(a) measuring the vertical displacement S of the drill string at the surface, (b) determining a state space description of S comprising a state space measurement equation:

$$S = [1\ 0\ 0\ 0]\begin{bmatrix} s \\ \Delta s \\ \Lambda \\ \Delta d \end{bmatrix} + \rho$$

and a state evolution equation:

$$\begin{bmatrix} s \\ \Delta s \\ \Lambda \\ \Delta d \end{bmatrix}_{k+1} = \begin{bmatrix} 1 & \tau & 0 & 0 \\ 0 & 0 & -\Delta h & 1 \\ 0 & 0 & 1 & 0 \\ 0 & 0 & 0 & 1 \end{bmatrix} \cdot \begin{bmatrix} s \\ \Delta s \\ \Lambda \\ \Delta d \end{bmatrix}_{k} + r$$

wherein S and Δd are as previously defined, Δ is the difference operator for time τ between adjacent samples k and k+1, Λ is the drill string compliance, ρ is the noise term associated with the surface displacement measurement, r is the noise term associated with fluctuations in the state, and h is the hookload, and (c) applying a Kalman filter to said equations to obtain an estimate of the state parameters including Δd.

1 Claim, 4 Drawing Sheets

DETERMINATION OF DRILL BIT RATE OF PENETRATION FROM SURFACE MEASUREMENTS

The present invention relates to a method of determining the rate of penetration (ROP) of a drill bit from measurements made at the surface while drilling.

In the rotary drilling of wells such as hydrocarbon wells, a drill bit is located at the end of a drill string formed from a number of hollow drill pipes attached end to end which is rotated so as to cause the bit to drill into the formation under the applied weight of the drill string. The drill string is suspended from a hook and as the bit penetrates the formation, the hook is lowered so as to allow the drill string to descend further into the well. The ROP has been found to be a useful parameter for measuring the drilling operation and provides information about the formation being drilled and the state of the bit being used. Traditionally, ROP has been measured by monitoring the rate at which the drill string is lowered into the well at the surface. However, as the drill string, which is formed of steel pipes, is relatively long the elasticity or compliance of the string can mean that the actual ROP of the bit is considerably different to the rate at which the string is lowered into the hole. The errors which can be caused by this effect become progressively larger as the well becomes deeper and the string longer, especially if the well is deviated when increased friction between the string and the borehole wall can be encountered.

Certain techniques have been proposed to overcome these potential problems. In U.S. Pat. No. 2,688,871 and U.S. Pat. No. 3,777,560 the drill string is considered as a spring and:the elasticity of the string is calculated theoretically from the length of the drill string and the Young's modulus of the pipe used to form the string. This information is then used to calculate ROP from the load applied at the hook suspending the drill string and the rate at which the string is lowered into the well. These methods suffer from the problem that no account is taken of the friction encountered by the drill string as a result of contact with the wall of the well. FR 2038700 proposes a method to overcome this problem in which the modulus of elasticity is measured in situ. This is achieved by determining the variations in tension to which the drill string is subjected as the bit goes down the well until it touches the bottom. Since it is difficult to determine exactly when the bit touches the bottom from surface measurements, strain gauges are provided near the bit and a telemetry system is required to relay the information to the surface. This method still does not provide measurements when drilling is taking place and so is inaccurate as well as difficult to implement.

By contrast, in FR 2,165,851 (AU 44,424/72) there is employed a mathematical model describing the drill bit cutting rate—the model necessitates a knowledge of the drill depth, the drill rotational speed, and the weight on bit, and its use involves the application of a Kalman-Bucy filter—to derive an ROP value. This method suffers from the obvious problems of having to know what is really going on at the bit, and the model utilised applies only to roller cone bits. The later GB 2,129,141 A tries to deal with the problem in a related way, applying Kalman filtering to a model that treats the drillstring as an elastic cable, and provides a downhole bit-acceleration measurement device (together with a "motionless tool" sensor necessary for correcting certain errors in depth measurement). Though quite useful, this method, like that of the aforementioned FR 2,165,811, suffers from its requirement for knowledge of downhole conditions.

A simpler method is proposed in U.S. Pat. No. 4,843,875 (incorporated herein by reference) in which ROP is measured from surface measurements while drilling is taking place. This method uses the following model:

$$\Delta d = \Delta s + \Lambda \Delta h$$

wherein d is the downhole displacement, s is the surface displacement, $\Lambda$ is the drill string compliance and h is the axial force at the surface ($\Delta$ is the difference operator taken over some time interval $\tau$). Using the assumptions that over any time interval $\tau'$ (typically 5 minutes) drilling is at an average constant weight on bit (WOB), that the lithology does not change significantly, and the drill string behaves as a perfect spring, then a least squares regression is used to obtain an estimate of $\Lambda$. In a plot of $\Delta s$ against $\Delta h$, $\Lambda$ is the slope of the best fit line through the data points. The derived value of $\Lambda$ can be substituted back into the model to give ROP which can then be integrated to give hole depth. The choice of $\tau$ and $\tau'$ may be optimised with field experience. Unfortunately, implementation of this approach means that the drill string compliance is only updated at a time interval of $\tau'$, and control logic must be incorporated to ensure that the required assumptions are true. If this cannot be done, calculation of compliance must be suspended.

It is an object of the present invention to provide a method of determining ROP from surface measurements which can be used where the approach outlined above is undesirable or inappropriate.

In accordance with one aspect of the present invention, there is provided a method of determining the rate of penetration $\Delta d$ of a drill bit at the end of a drill string while drilling a well, comprising:

(a) obtaining by measurement an approximate value S for the actual vertical displacement s of the drill string mounted at the surface, (b) formulating a mathematical model to describe the vertical displacement of the drill string in terms of certain chosen physical parameters pertaining to the drill, and (c) applying a Kalman filter to said equations and then solving the system of equation to obtain an estimate of the state parameters including $\Delta d$, characterised in that the mathematical model is a mathematical state space model of the system, comprising a state space measurement equation defining the value S:

$$S = [1\ 0\ 0\ 0] \begin{bmatrix} s \\ \Delta s \\ \Lambda \\ \Delta d \end{bmatrix} + \rho$$

(wherein S, $\Delta d$, and s are as previously defined, $\Delta$ is the difference operator for time $\tau$ between adjacent samples k and k+1, $\Lambda$ is the drill string compliance, and $\rho$ is the noise term associated with the surface displacement measurement)

and a state evolution equation:

$$\begin{bmatrix} s \\ \Delta s \\ \Lambda \\ \Delta d \end{bmatrix}_{k+1} = \begin{bmatrix} 1 & \tau & 0 & 0 \\ 0 & 0 & -\Delta h & 1 \\ 0 & 0 & 1 & 0 \\ 0 & 0 & 0 & 1 \end{bmatrix} \begin{bmatrix} s \\ \Delta s \\ \Lambda \\ \Delta d \end{bmatrix}_{k} + r$$

(wherein all the symbols are as previously defined, with the additions of r being the noise term associated with fluctuations in the state, h being the hookload, and Δh being the hookload rate of change).

The present invention uses the same basic model as that of the aforementioned U.S. Pat. No. 4,843,875 formulated in state space, and uses Kalman filtering as a continuously adaptive technique to solve the state S parameters.

As is explained in more detail hereinafter, the actual surface vertical displacement s when measured becomes the approximate value S because of various uncertainties and inaccuracies referred to generally as "noise" (the term "ρ").

The present invention will now be described, by way of example, with reference to the accompanying drawings in which.

Figure 1:
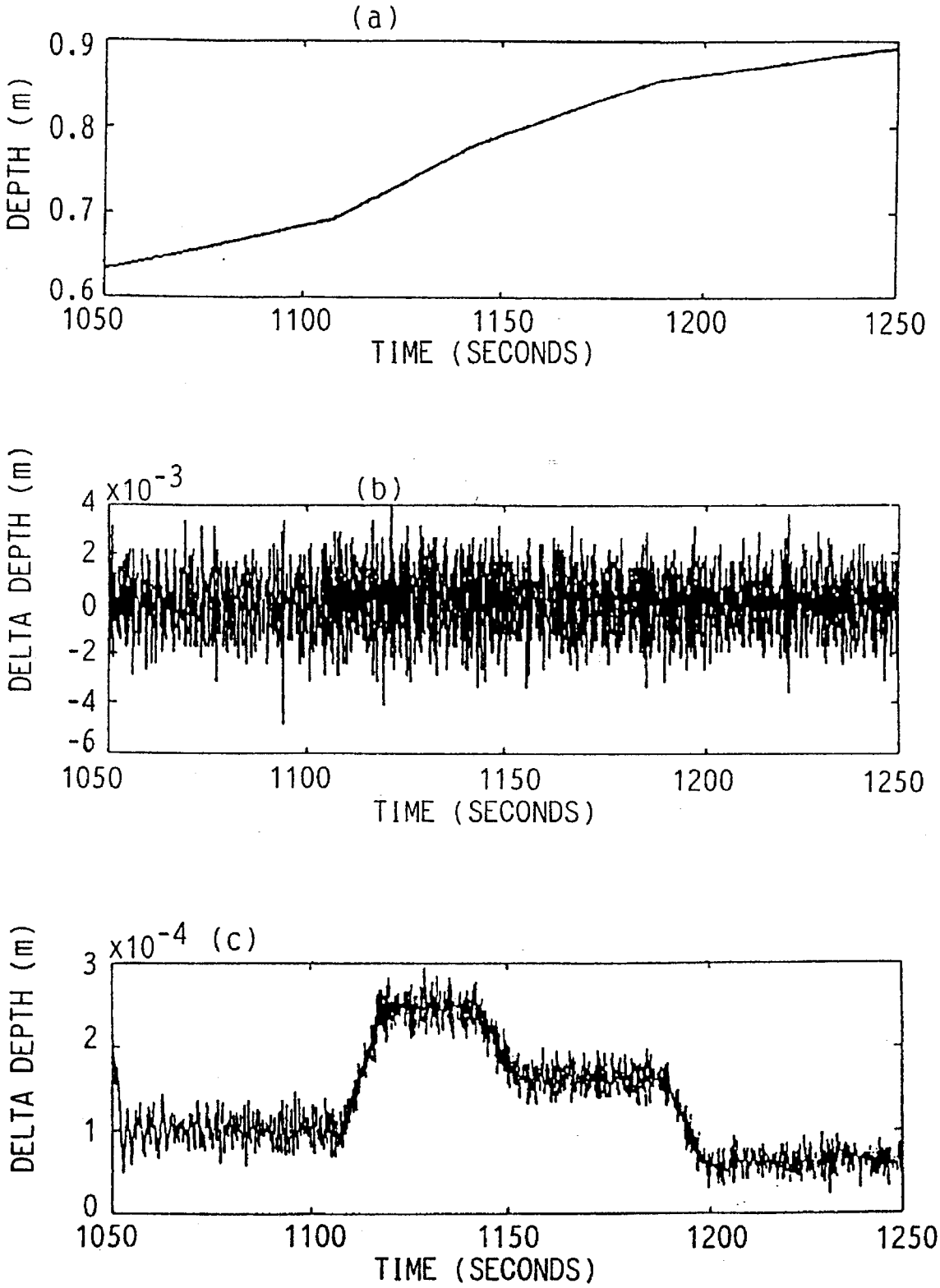
FIG. 1 shows plots of the data obtained from experimental apparatus.
Figure 2:
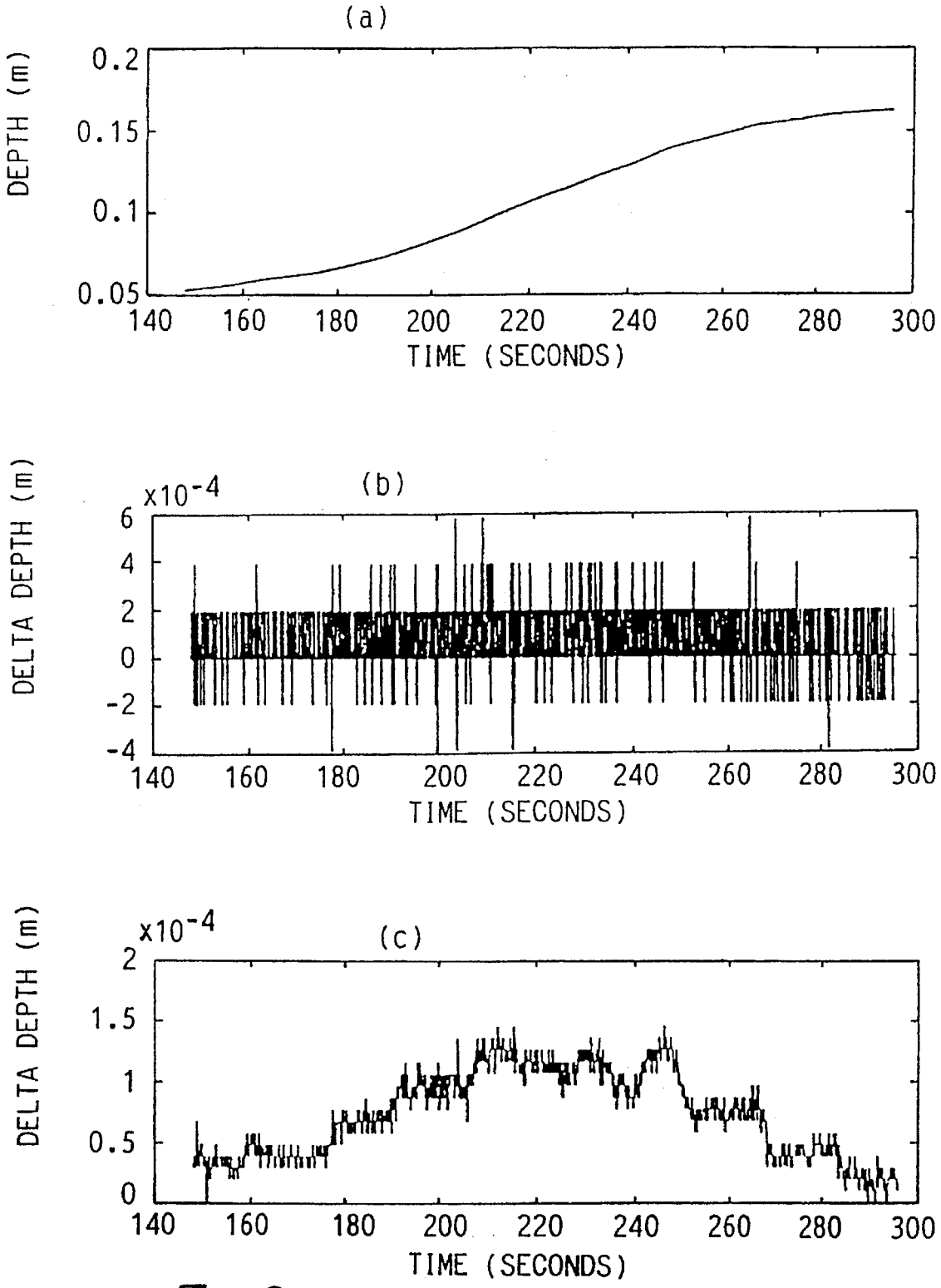
FIG. 2 shows plots of the data obtained from further experimental apparatus.

Referring now to the drawings, the data shown in FIGS. 1 and 2 are obtained from experimental apparatus designed to provide realistic drilling data in controllable conditions. Such apparatus is described in U.S. Pat. No. 4,928,521 which is incorporated herein by reference.

The two examples from the experimental apparatus demonstrate the difficulties with ROP calculations.

FIG. 1(*a*) shows the raw depth measurement from an experiment in a drilling test machine with a PDC bit drilling marble. The derivative of this measurement, calculated by differencing adjacent points, is shown in 1(*b*). A "noise" level of about ±2 mm is apparent, and totally masks the underlying trend. Smoothing this derivative, as shown in FIG. 1(*c*) (10 second averaging used) yields an indication of the ROP, but the estimate still has a high variance and the averaging has introduced a damped response to sharp changes in weight on bit. Further reduction of the variance by increasing the averaging time will result in a steady state estimate of ROP never being achieved for the finite duration drilling segments.

Another example is shown in FIG. 2, taken from a test in a different drilling machine. FIG. 2(*a*) shows the depth measurement and 2(*b*) its derivative. Here again, the derivative calculation is very noisy, but the nature of the noise is different—it is not due to vibrations, but to quantisation (about 0.2 mm steps) in the original depth measurement. FIG. 2(*c*) shows a 2 second average of the depth derivative. The underlying ROP trend is apparent but the variance due to measurement quantisation is still high. Increasing the averaging time would blur the boundaries between the different drilling segments.

Both these examples demonstrate the problem with the direct calculation of ROP as a derivative of depth. Vibrations and measurement quantisation noise are also observed in field measurements.

An alternative approach to ROP estimation is provided by the present invention by the use of a state-space approach.

A state-space model comprises two equations: a measurement equation describing how observable measurements relate to the state vector, and a state evolution equation showing how the components of the state vector evolve in time. The state vector itself is a complete description of the system and contains parameters to be estimated.

The state-space model applicable to the ROP problem has a state vector X with components: displacement s, surface ROP Δs, compliance Λ and downhole ROP Δd $$X=\begin{bmatrix} s \\ \Delta s \\ \Lambda \\ \Delta d \end{bmatrix} \tag{1}$$

The observed parameter is displacement s, so the measurement equation (H=measurement matrix) is simply $$s=[1\ 0\ 0\ 0]\begin{bmatrix} s \\ \Delta s \\ \Lambda \\ \Delta d \end{bmatrix}=HX \tag{2}$$

and the state evolves in this manner (Φ=state transition matrix)

$$X_{k+1}=\begin{bmatrix} 1 & \tau & 0 & 0 \\ 0 & 0 & -\Delta h & 1 \\ 0 & 0 & 1 & 0 \\ 0 & 0 & 0 & 1 \end{bmatrix} \tag{3}$$

where τ is the time interval between adjacent sampling instants indicated by subscripts k and k+1.

The depth measurement itself will contain noise and the above "model" chosen to represent the system will not be exactly true (e.g. there may be perturbing accelerations). The measurement and state evolution equations can be modified to include additive noise components ($\rho_k$, $r_k$) which account for these discrepancies. In a general formulation for state space models, the matrices H and Φ may also be time-varying. Using conventional notation (y= observed output values) we have $$y_k=H_kX_k+\rho_k \tag{4}$$

$$X_k=\Phi_kX_{k-1}+r_k \tag{5}$$

The second order statistics (covariance matrices) of the noise components $\{\rho_k, r_k\}$ may be written as $$R_k=E\{\rho_k\rho^T\} \tag{6}$$

$$Q_k=E\{r_kr_k^T\} \tag{7}$$

(where E is the expectation operator and T is the matrix transpose operator). Taking a least-squares approach, we seek the "best" estimate $\hat{X}_k$ of the actual state $X_k$. The difference between the estimate and the true state can be expressed in the offset covariance matrix $$P_k=E\{(X_k-\hat{X}_k)(X_k-\hat{X}_k)^T\} \tag{8}$$

The optimum solution to this problem (i.e. the one which minimises the trace of the matrix P) was given by Kalman (R E Kalman. A new approach to linear filtering and prediction problems. In *Trans. ASME,* March 1960) and a summary of the Kalman filter equations is given in Appendix A. The filter provides estimates of State $\hat{X}_k$ and offset covariance P at each sampling instant given a knowledge of Q and R, the noise covariances.

The measurement noise variance R can be estimated from the depth derivative. In the case of the data shown in FIG. 1, the standard deviation of the noise is calculated to be ~1 mm, so $R=1\times10^{-6}$. For the FIG. 2 data, the quantisation step size controls the variance, giving $R=4\times10^{-8}$.

An estimation of Q may be made by considering a perturbing acceleration $a_k$.

$$r_k = X_k - \Phi_k X_{k-1} = \begin{bmatrix} 0 \\ a_k \tau \end{bmatrix} \tag{9}$$

so the state covariance is $$Q = \begin{bmatrix} 0 & 0 \\ 0 & \sigma_a^2 \Delta t^2 \end{bmatrix} \tag{10}$$

where $\sigma_a^2 = E\{a_k a_k^T\}$, the variance of the acceleration, is chosen on the basis of a knowledge of expected ROP variations.

The ratio between R and $\sigma_a^2$ incorporates the same trade-off between response time and estimate variance as the choice of window width in the conventional processing; however, the formulation in terms of measurement and state noise levels makes explicit the values to be used. The performance of the Kalman filter is almost entirely determined by the choice of Q. Techniques to estimate Q from the data are non-trivial and have been discussed at length in H W Sorenson, editor, *Kalman filtering: theory and applications. Selected Reprints,* IEEE Press, 1985.

Since the Kalman filter is a recursive estimator, initial conditions are required for $\hat{X}$ and P. In the following examples, the initial conditions $$\hat{X}_0 = \begin{bmatrix} d_1 \\ d_2 - d_1 \end{bmatrix} \tag{11}$$

$$P_0 = 10Q \tag{12}$$

have been used. Selection of these is not crucial since the filter will continuously correct for estimation errors and converge to the correct solution, leaving a start-up transient in the estimate if the initial values were very much in error.

The above processing has been applied to the two drilling machine examples previously shown.

Figure 3:
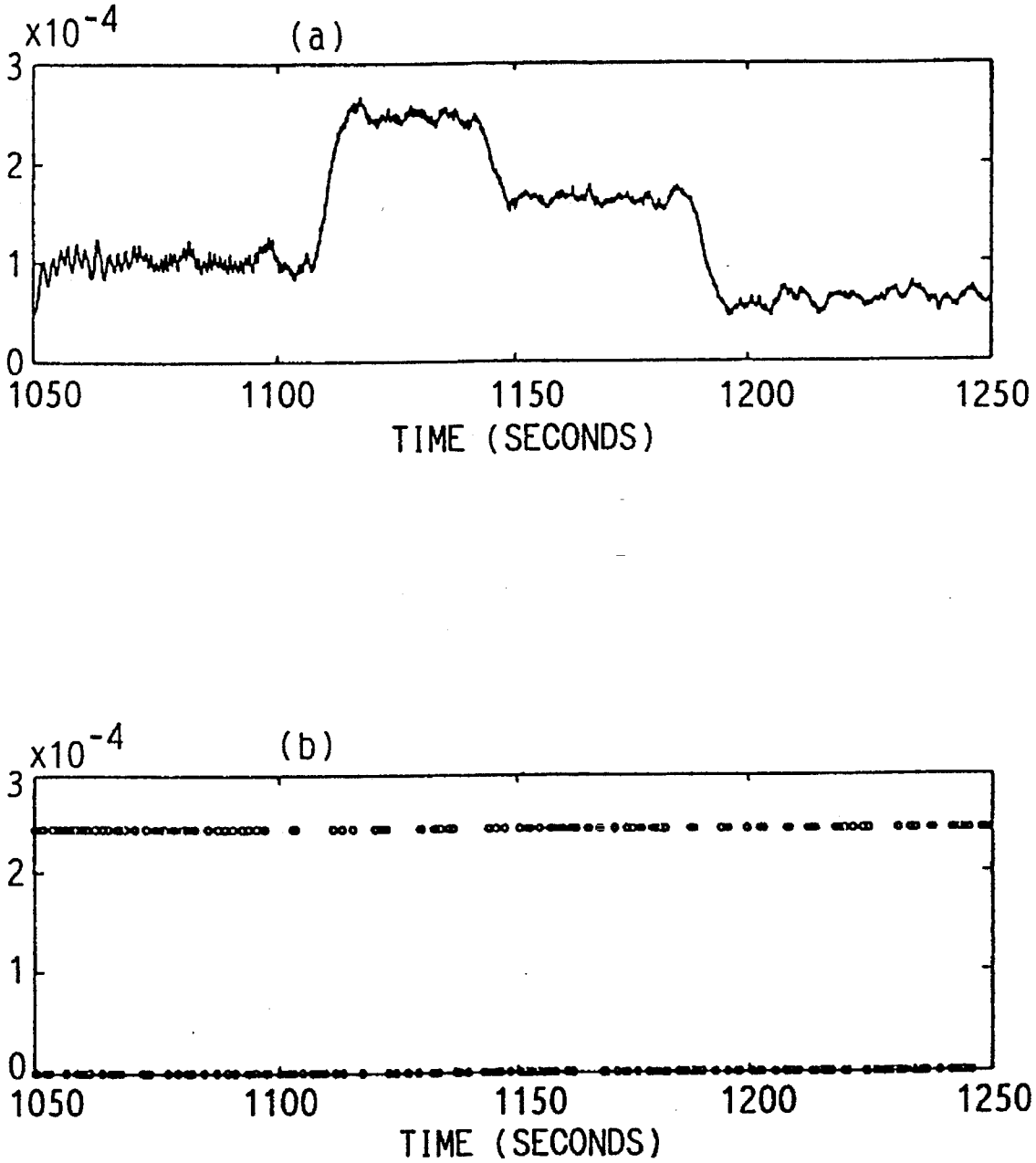
FIG. 3 and 4 show plots of data analysed by the present invention corresponding to FIGS. 1 and 2.

FIG. 3(*a*) shows the ROP estimate for the FIG. 1 data and should be compared with FIG. 1(*c*), the conventional ROP estimate. $\sigma_\alpha^2 \Delta t^2$ has been chosen to be $1\times10^{-11}$. Not only is the variance considerably lower, but the response time of the Kalman estimator to step changes in WOB is faster. It is interesting to compare the estimate with the original depth derivative calculated on a sample by sample basis (i.e.—$d_{k+1} = -d_k$). This is shown in FIG. 3(*b*) (plotted as discrete points on the same scale as FIG. 1(*c*). The ROP estimate is of the same order as a single quantisation step in the original data.

Figure 4:
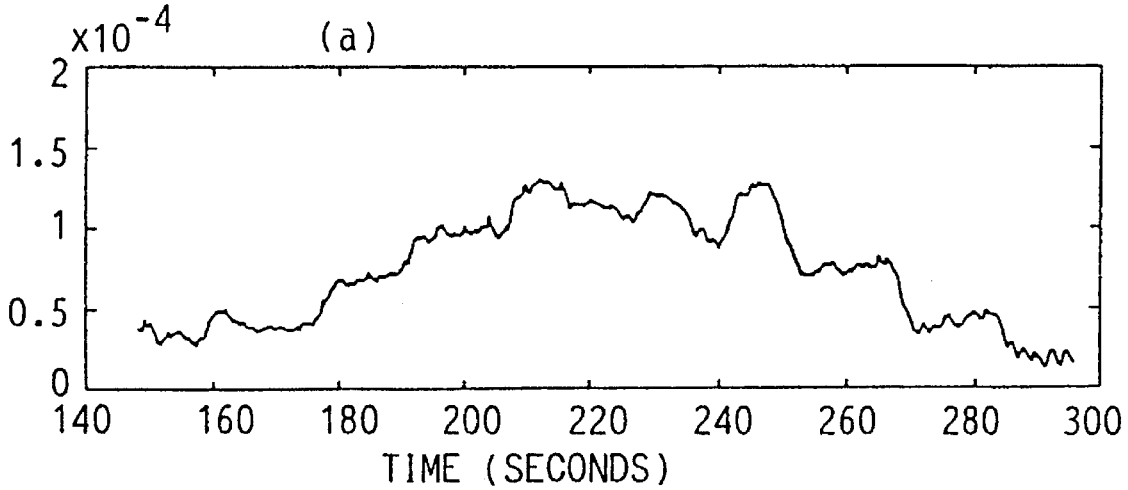
Figure 4:
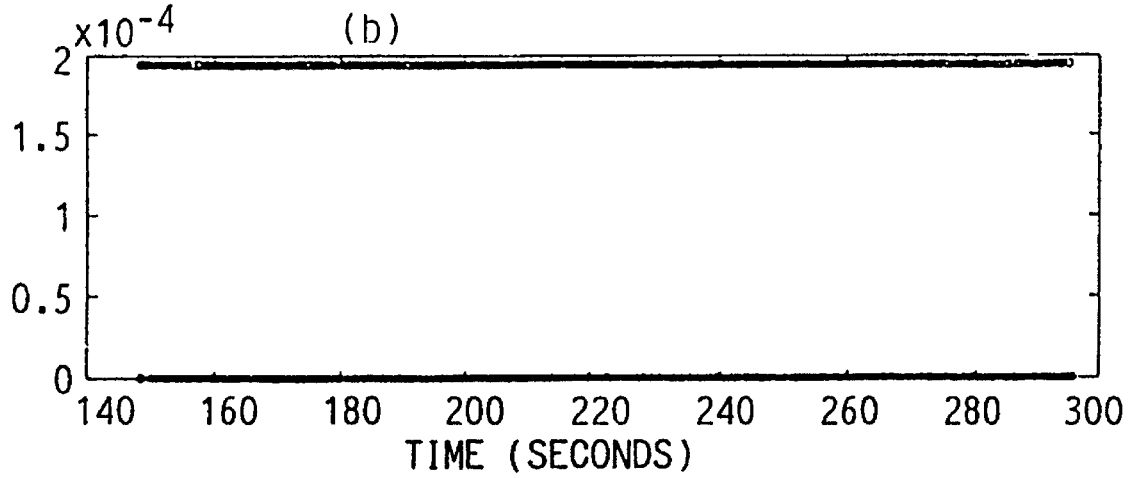

FIG. 4 shows the processing applied using the data shown in FIG. 2. Here the choice of $\sigma_\alpha^2 \Delta t^2 (3\times10^{-12})$ is such as to make the response time similar to the 2 second averaging used in FIG. 2. The variance of the measurement, due mainly to the original quantisation is much less than the conventional processing. Again, FIG. 4(*c*) shows the quantisation level of the original depth derivative.

In the following Appendices, Appendix A gives the Kalman filter equations, Appendix B gives a generalised code in Matlab to implement the Kalman filter, and Appendix C gives an example of use of the code.

APPENDIX A

Given the following state-space model $$y_k = H_k X_k + \rho_k$$

$$X_k = \Phi_k X_{k-1} + r_k$$

and defining various noise covariances $$P_k = E\{(X_k - \hat{X}_k)(X_k - \hat{X}_k)^T\}$$

$$Q_k = E\{r_k r_k^T\}$$

$$R_k = E\{\rho_k \rho_k^T\}$$

then the Kalman filter equations to estimate X are

Prediction

At index $k$ know $$\Phi_{k+1}, \hat{X}_{k,k}, P_{k,k}, Q_k$$

$$\hat{X}_{k+1,k} = \Phi_{k+1} \hat{X}_{k,k}$$

$$P_{k+1,k} = \Phi_{k+1} P_{k,k} \Phi_{k+1}^T + Q_k$$

Correction

At index $k + l$ measure $$H_{k+1}, Y_{k+1}, R_{k+1}$$

$$K_{k+1} = P_{k+1,k} H_{k+1}^T (H_{k+1} P_{k+1,k} H_{k+1}^T + R_{k+1})^{-1}$$

$$\hat{Y}_{k+1,k} = H_{k+1} \hat{X}_{k+1,k}$$

$$\hat{X}_{k+1,k+1} = \hat{X}_{k+1,k} + K_{k+1}(Y_{k+1} - \hat{Y}_{k+1,k})$$

$$P_{k+1,k+1} = (l - K_{k+1} H_{k+1}) P_{k+1,k}$$

APPENDIX B

Matlab Code (.M file)

A generalized Matlab code to implement the Kalman filter described in Appendix A for constant H and Φ matrices is shown below.

```
function [X, P, e] = kalengine(z, H,Phi Q,R,P, XO)
%KALENGINE
%
% [X,P,e] = kalengine(z, H,Phi, Q,R,P, XO)
%
%     Basic KALMAN ENGINE, for constant H and
      Phi matrices
%     NB: Limited to scalar problems for the moment.
%
%
% Modified:
%
[mz,nz] = size(z); % Dimensions
[mh,nh] = size(H);
[mf,nf] = size(Phi);
[mq,nq] = size(Q);
[mr,nr] = size(R);
[mp,np] = size(P);
[mx,nx] = size(XO);
%
if nz ~= 1; error('Sorry, scalar problems only'); end
if mh ~= nz; error('H is wrong size'); end
if mf ~= nf; error('Phi should be square'); end
if nf ~= nh; error('Phi is wrong size'); end
if mq ~= nq; error('Q should be square'); end
if nq ~= nh; error('Q is wrong size'); end
if mr ~= nr; error('R should be square'); end
if nr ~= nz; error('R is wrong size'); end
if mp ~= np; error('P should be square'); end
if np ~= nh; error('P is wrong size'); end
if nx ~= 1; error('XO should be column vector'); end
if mx ~= mf; error('XO is wrong size'); end
%
disp('KALMAN ENGINE - Warning: using .M file, not .MEX')
%
n = mz;
m = nh;
%
X = zeros(m,n);                    % allocate output variables
```

-continued

```
I = eye(m);
e = zeros(z);
%
X(:,1) = XO;
e(1,:) = z(1,:) - H * XO;
%
for i = 2:n
  k = i - 1;
  P = Phi * P * Phi' + Q;          % predict offset variance
  K = P * H' /                     % KALMAN gain
  (H * P * H' + R);
  Xhat = Phi * X(:,k);             % state prediction
  Z = H * Xhat;                    % measurement prediction
  E = z(i,:) - Z;                  % innovation sequence
  e(i,:) = E;
  X(:,i) = Xhat + K * E;           % state estimate
  P = (I - K * H) * P;             % variance estimate
end
%
X=X';
%
```

The Matlab routine has been implemented as a FORTRAN .MEX file, which yields a speed improvement of a factor of 50 over the .M file version.

APPENDIX C

Example of using KALENGINE.M

The simple state space model developed in section 3.1 is given as an example of using the generalized code given in the previous Appendix.

Recall that for this model $$H = [1 \quad 0]$$

$$\Phi = \begin{bmatrix} 1 & \Delta t \\ 0 & 1 \end{bmatrix}$$

```
function [X, P, e] = kalrop(z,Q,R,P)
%KAL
%
%       X = kalrop(height, Q,R) - Kalman filter
%
%     X = [ height rop ] - ROP from displacement measurement
%
%     USING KALMAN ENGINE
%

d = z(1);
v = z(2) - z(1);
X0 = [ d v ]';          % initial guess
H = [ 1 0 ];
Phi = [ 1 1 ; 0 1 ];
if nargin <4, P = 10*Q; end
%
[X,P,e] = kalengine(z, H,Phi, Q,R,P, X0);
%
```

This function was used to compute the examples shown in figures and >>X=kalrop(depth,Q,R).

I claim:

1. A method of determining the rate of penetration Δd of a drill bit at the end of a drill string while drilling a well, comprising:

(a) installing and connecting compatible components of mechanical drill bit hardware, electronic instruments, and a computer program system to a drill string that is to be lowered into a well at a known rate observed relative to the surface;

(b) measuring while drilling a value S, representing the noise distorted actual vertical displacement s of the drill string at the surface;

(c) formulating a mathematical model to describe the vertical displacement of the drill string within the well in terms of certain chosen physical parameters pertaining to the drilling with drill bit hardware, the electronic instruments, and a mode of drilling operation, such as drill string compliance, hookload, hookload rate, and an error due to noise distortion contributions from electrical noise, mechanical vibrations and/or as representing random state fluctuations, wherein said mathematical model is a mathematical state space model of the evolving system, comprising a state space measurement equation for the state parameters S, s taken at different times for consecutive or adjacent samples k(i)=k+i, where i is equal to 1,2,3, . . . last data sample;

$$S = [1\,0\,0\,0]\begin{bmatrix} s \\ \Delta s \\ \Lambda \\ \Delta d \end{bmatrix} + \rho$$

wherein S, Δd, and s are as previously defined, Δ is the difference operator for time τ between adjacent samples k and k+1, Λ is the drill string compliance, and ρ is the noise term associated with the surface displacement measurement corresponding to the drill bit penetration, and a state evolution equation;

$$\begin{bmatrix} \sigma \\ \Delta\sigma \\ \Lambda \\ \Delta\delta \end{bmatrix}_{k+1} = \begin{bmatrix} 1 & \tau & 0 & 0 \\ 0 & 0 & -\Delta h & 1 \\ 0 & 0 & 1 & 0 \\ 0 & 0 & 0 & 1 \end{bmatrix} \begin{bmatrix} s \\ \Delta s \\ \Lambda \\ \Delta d \end{bmatrix}_k + r$$

wherein all the symbols are as previously defined, with the additions of r being the noise term associated with fluctuations in the state, h being the hookload, and Δh being the hookload rate over the same time interval τ of change;

(d) applying a Kalman filter to said equations to obtain a noise-compensated estimate of the state parameters S, s; and (e) using said estimate to determine said actual rate of penetration Δd of said drill bit within the well while drilling said well, absent the effect of said noise distortion.

* * * * *